US008109330B1

(12) United States Patent
Miller

(10) Patent No.: US 8,109,330 B1
(45) Date of Patent: Feb. 7, 2012

(54) INLINE CHOKE AND ANGLED CHOKE FOR USE WITH OIL FIELD EQUIPMENT

(76) Inventor: James Otis Miller, Tomball, TX (US)

( * ) Notice: Subject to any disclaimer, the term of this patent is extended or adjusted under 35 U.S.C. 154(b) by 0 days.

(21) Appl. No.: 13/117,967

(22) Filed: May 27, 2011

(51) Int. Cl.
*E21B 43/12* (2006.01)

(52) U.S. Cl. ..... 166/91.1; 166/97.1; 166/320

(58) Field of Classification Search ..... 166/91.1, 166/97.1, 320, 332.1, 332.2; 251/121, 122; 137/315.02; 138/43
See application file for complete search history.

(56) References Cited

U.S. PATENT DOCUMENTS 1,911,905 A * 5/1933 Knowlton et al. ..... 166/91.1
2,132,199 A * 10/1938 Yancey ..... 166/76.1
2,278,050 A 3/1942 Allen et al.
3,102,709 A 9/1963 Allen
3,379,255 A 4/1968 Burns, Jr. et al.
4,265,424 A 5/1981 Jones
4,337,788 A * 7/1982 Seger ..... 137/315.02
4,550,895 A 11/1985 Shaffer
4,705,062 A * 11/1987 Baker ..... 137/315.02
5,333,832 A 8/1994 Bartholomew et al.
5,944,110 A 8/1999 Watts et al.
6,089,526 A 7/2000 Olson
6,857,634 B2 2/2005 Araujo
6,955,357 B2 10/2005 Griffin et al.

* cited by examiner

*Primary Examiner* — David Andrews
(74) *Attorney, Agent, or Firm* — Buskop Law Group, P.C.; Wendy Buskop

(57) ABSTRACT

An angled or inline choke for flowing drilling fluid to a choke and kill manifold, wherein the choke has a body with a bore, a connection can be sealed to the body and can have a connection bore in communication with the bore. A locking plate can index the connection to the body. The choke can have a cavity with a piston. A port can be in communication with the cavity to provide a hydraulic fluid to the piston. A choke bean in the bore can flow drilling fluid to the choke and kill manifold. A tip can connect to the choke bean with a rod. When the hydraulic fluid passes into the port, the piston can move within the bore and compress a choke element around the tip to cause restriction of the drilling fluid, enabling for control of a pressure of the drilling fluid.

20 Claims, 8 Drawing Sheets

INLINE CHOKE AND ANGLED CHOKE FOR USE WITH OIL FIELD EQUIPMENT

FIELD

The present embodiments generally relate to an inline choke and an angled choke for use with oil field equipment, such as choke and kill manifolds.

BACKGROUND

A need exists for an inline choke and an angled choke of modular construction that has modular parts.

A need exists for inline and angled chokes that are longer lasting than existing chokes.

A need exists for inline and angled chokes that are easy to repair and replace.

The present embodiments meet these needs.

BRIEF DESCRIPTION OF THE DRAWINGS

The detailed description will be better understood in conjunction with the accompanying drawings as follows.

Figure 1:
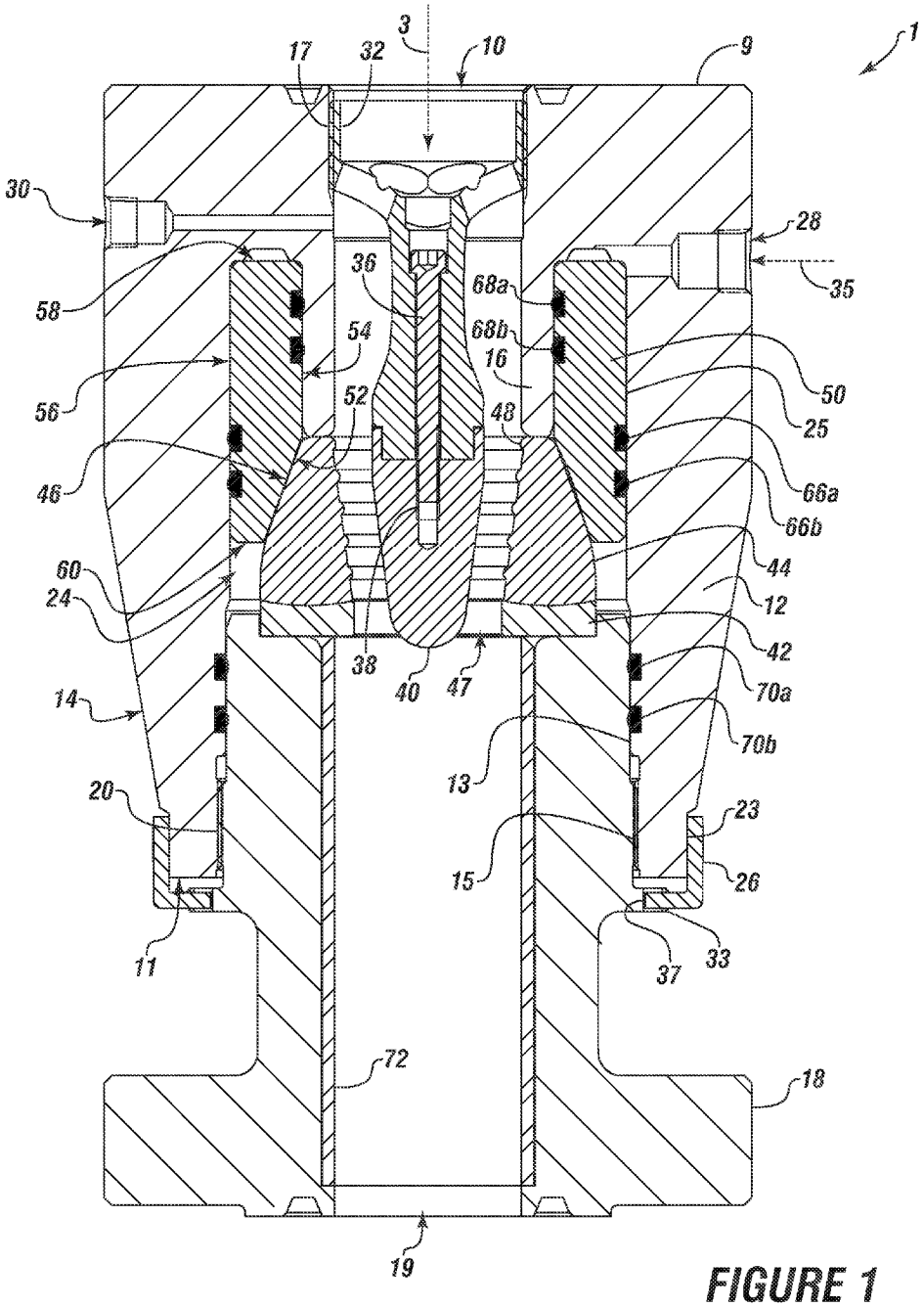
FIG. 1 is a cross sectional view of an embodiment of an inline choke.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to an inline choke and an angled choke usable with a choke bean to control the flow of drilling fluid to a choke and kill manifold.

The inline choke and the angled choke can be used with oil field equipment for providing drilling fluid to the choke and kill manifold or other oil field equipment requiring control of drilling fluid in a well bore.

The inline choke and angled choke can each have a choke body with a top and a choke longitudinal bore.

In one or more embodiments, the choke body can include an extended body having an upper body that allows drilling fluid to enter the choke before entering a choke bean within the choke. In embodiments, the choke body can have a top that has no extended or upper body above the choke bean.

The choke body can have an outer body portion and an inner body portion. The outer body portion can be integral and partially separated from an inner body portion. The outer body portion can include tapered outer sides.

A piston cavity can be disposed between the outer body portion and the inner body portion. The piston cavity can support a piston. The piston can have a piston tapered inner edge, a piston upper inner seal face, a piston outer seal face, a piston top, and a piston bottom.

The outer body portion and the inner body portion can each have threads, allowing the choke body to be threadably engaged with other components.

For example, the choke body can be engaged with a flanged connection, such as an American Petroleum Institute (API) flanged connection. The flanged connection can threadably engage and seal with the outer body portion.

The flanged connection can have a flanged connection longitudinal bore axially aligned with the choke longitudinal bore. The flanged connection longitudinal bore can be in fluid communication with the choke longitudinal bore.

In one or more embodiments the flanged connection can have a first flanged connection longitudinal bore aligned with the choke longitudinal bore and a second flanged connection longitudinal bore disposed at a right angle to the first flanged connection longitudinal bore. The first flanged connection longitudinal bore can be in fluid communication with the choke longitudinal bore. The second flanged connection longitudinal bore can be in fluid communication with the first flanged connection longitudinal bore.

In one or more embodiments, flanged connection threads can be formed along the flanged connection longitudinal bore for threadably engaging with the outer body threads of the choke body. The choke body and the flanged connection can be removable from each other, allowing for individual replacement of each.

The flanged connection can have a plurality of flanged connection thru bores formed therein, which can engage fasteners, such as bolts.

A studded top connection can be connected to or disposed on a top of the choke body. The studded top connection can be an API connection.

A locking plate can be engaged to both the flanged connection and the outer body portion. The locking plate can be engaged on an end of the choke body opposite the top. The locking plate can index the flanged connection to the outer body portion and align the studded top connection with existing oil field equipment.

A close port in the choke body can be in fluid communication between a hydraulic control fluid source and the piston cavity for providing hydraulic control fluid to the piston.

The inline choke and the angled choke can both include from about one test port to about three test ports. The test ports can be disposed through the choke body, the flanged connection, or both. The test ports can be used to continuously sense pressure in the choke longitudinal bore, the flanged connection longitudinal bore, another section of the choke, or combinations thereof.

A choke bean, such as those made by Cameron Iron Works (CIW) or FMC, can be axially disposed in the choke longitudinal bore and threaded to the inner body threads. The choke bean can receive drilling fluid and flow the drilling fluid to the choke and kill manifold.

A connecting rod, such as a bolt, can axially extend from the choke bean down the choke longitudinal bore to engage a carbide tip. The carbide tip can be tapered.

The carbide tip can be removably engaged with the connecting rod, allowing each to be individually replaced, thereby providing the choke with a modular construction and a longer life span.

An elastomeric choke element can be positioned in the choke longitudinal bore between the piston and the carbide tip. The elastomeric choke element can have an elastomeric choke element body, which can be cylindrical. The elastomeric choke element can have an elastomeric choke element outer tapered edge, which can be fitted against the piston. The elastomeric choke element can have an elastomeric choke element tapered thru bore that can be axially aligned with the choke longitudinal bore.

A support ring can be disposed between the elastomeric choke element and the flanged connection to keep the elastomeric choke element in the choke body and prevent extrusion of the elastomeric choke element therefrom.

In one or more embodiments, an erosion resistant liner can be in the flanged connection longitudinal bore. The erosion resistant liner can be a carbide liner. The erosion resistant liner can be high carbon steel, carbide, ceramic, a ceramic and glass combination, or combinations thereof.

A plurality of rod seals can seal between the piston and the outer body, the piston and the inner body, and the inner body and the flanged connection. The rod seals can be elastomeric seals with metal springs or s-rings, such as those made by Utex Industries or James Walker Oil & Gas Company of Houston, Tex.

In operation of the inline choke and angled choke, hydraulic control fluid can pass into the close port, and the piston can move in a first direction axially in the choke longitudinal bore.

The moving piston can engage the elastomeric choke element and compress the elastomeric choke element around the carbide tip, thereby choking or restricting the drilling fluid passing through the choke bean.

The choking or restricting of the drilling fluid passing through the choke bean can enable the choke body to control pressure of the drilling fluid to the choke and kill manifold.

When the pressure of the hydraulic fluid is released, the piston can move in a second direction opposite the first direction, and the elastomeric choke element can relax and substantially return to its original shape.

In one or more embodiments, the choke studded top connection and the flanged connection can be configured to accommodate oil field equipment having a 1 and 13/16 inch diameter connection, a 2 and 1/16 inch diameter connection, a 2 and 9/16 inch diameter connection, a 3 and 1/16 inch diameter connection, or a 4 and 1/16 inch diameter connection.

In embodiments, the elastomeric choke element can be made from a compressible synthetic rubber, a compressible polymer composite having a durometer ranging from about 60 duro to about 90 duro, a hydrogenated nitrile butadiene rubber, another synthetic rubber, a fluoroelastomer, such as VITON® available from DuPont, or combinations thereof.

The elastomeric choke element can be configured to withstand temperatures ranging from about −20 degrees Fahrenheit to about 250 degrees Fahrenheit.

In one or more embodiments, a plurality of elastomeric choke element inner ridges can be formed in the elastomeric choke element, such as on an elastomeric choke element tapered thru bore. The plurality of elastomeric choke element inner ridges can extend into the choke longitudinal bore. In operation, when the elastomeric choke element is compressed by the piston, the plurality of elastomeric choke element inner ridges can engage the carbide tip, enabling the elastomeric choke element tapered thru bore to engage against the carbide tip for restricting the flow of the drilling fluid.

In one or more embodiments, from about two to about eight elastomeric choke element inner ridges can be positioned around the elastomeric choke element tapered thru bore.

Turning now to the Figures, FIG. 1 depicts a cross sectional view of an embodiment of the inline choke 1.

The inline choke 1 can have a top 9, a bottom 11, and a choke longitudinal bore 10 disposed through the inline choke 1.

The inline choke 1 can have an outer body portion 12 and an inner body portion 16, each having different diameters. For example, the inner body portion 16 can have a smaller diameter than the outer body portion 12, such as a diameter that is about 20 percent smaller than the diameter of the outer body portion 12.

The outer body portion 12 can have tapered sides 14, which can taper towards a flanged connection 18. The slope of the tapered sides 14 can range from about 10 degrees to about 30 degrees from the choke longitudinal bore 10.

Proximate the bottom 11, the inline choke 1 can have a cylindrical outer surface 23 on an outer surface of the outer body portion 12.

Also proximate the bottom 11, the inline choke 1 can have a seal side 13 on an inner surface of the outer body portion 12. The cylindrical outer surface 23 can extend parallel to the seal side 13.

A locking plate 26 can be engaged with the cylindrical outer surface 23 and with the flanged connection 18. The locking plate 26 can have an L-shaped configuration.

The locking plate 26 can be engaged with a flanged connection extension 33 on the flanged connection 18. The flanged connection extension 33 can a have locking plate recesses 37 for receiving the locking plate 26.

The locking plate 26 can align the outer body portion 12 with the flanged connection 18. The locking plate 26 can be fixed to the flanged connection 18 and removably engaged with the outer body portion 12.

The outer body portion 12 can be threadably engaged with the flanged connection 18. For example, the outer body portion 12 can have outer body internal threads 15 on the seal side 13. As such, the outer body portion 12 can have a secure sealed engagement with the flanged connection 18.

The outer body internal threads 15 can threadably engage with flanged connection threads 20, which can be formed on an outer surface of the flanged connection 18.

The flanged connection 18 can have a flanged connection longitudinal bore 19, which can be in fluid communication with the choke longitudinal bore 10. The flanged connection longitudinal bore 19 can be axially aligned with the choke longitudinal bore 10.

The diameters of the flanged connection longitudinal bore 19 and the choke longitudinal bore 10 can range from about 2 inches to about 5 inches.

In one or more embodiments, the flanged connection 18 can have a base with a diameter ranging from about 8 inches to about 14 inches, and a body extending from the base with a diameter ranging from about 4 inches to about 8 inches.

An erosion resistant liner 72, such as a carbide liner, can line the flanged connection longitudinal bore 19. The erosion resistant liner 72 can have a thickness ranging from about 0.01 inches to about 0.3 inches.

The inline choke 1 can have inner body threads 17 at the top 9. The inner body threads 17 can threadably engage with a choke bean 32.

The choke bean 32 can be positioned within the choke longitudinal bore 10. The choke bean 32 can transfer drilling fluid 3 from a drilling fluid source, such as a mud pump or another source, to the flanged connection longitudinal bore 19.

The choke longitudinal bore 10 can open into an annular recess 24. The annular recess 24 can support an elastomeric choke element 44.

The inner body portion 16 and the outer body portion 12 can be separated by a piston cavity 25. A piston 50 can be contained within the piston cavity 25. The piston cavity 25 can extend into the annular recess 24 without extending into the choke longitudinal bore 10.

The piston cavity 25 can support the piston 50. In operation, the piston 50 can push against the elastomeric choke element 44 when hydraulic control fluid 35 flows into a close port 28 of the inline choke 1.

The piston 50 can have a piston upper inner seal face 54, a piston outer seal face 56, a piston top 58, and a piston bottom 60. In operation, the piston top 58 can be directly engaged by the hydraulic control fluid 35.

The inline choke 1 can have first piston seals 66*a* and 66*b*, which can seal in parallel on the piston outer seal face 56.

The inline choke 1 can have first rod seals 68*a* and 68*b*, which can seal the piston upper inner seal face 54 to the inner body portion 16.

The inline choke 1 can have second rod seals 70*a* and 70*b*, which can seal the seal side 13 to the flanged connection 18.

The elastomeric choke element 44 can have a thru bore 47, which can be an elastomeric choke element body tapered thru bore. The elastomeric choke element 44 can have an elastomeric choke element outer tapered edge 46, which can engage a piston tapered inner edge 52 of the piston 50, allowing the piston 50 to apply pressure to the elastomeric choke element 44 to compress the elastomeric choke element 44.

The piston 50 can be driven in a first direction, also called the close direction, by the hydraulic control fluid 35, which can be introduced through the close port 28. The close port 28 can extend from the outer body portion 12 to the piston cavity 25 to allow the hydraulic control fluid 35 to engage the piston 50.

A first test port 30 can be disposed through the outer body portion 12 and into the choke longitudinal bore 10. The first test port 30 can allow an operator to test for pressure in the choke longitudinal bore 10 near the choke bean 32.

In operation, the choke bean 32 can receive the drilling fluid 3 and control the flow of the drilling fluid 3.

The choke bean 32 can have a connecting rod 36 extending from one end of the choke bean 32. The connecting rod 36 can be threaded onto a carbide tip 40, which can be tapered.

The connecting rod 36 can have a threaded portion 38 to ensure a secure and removable engagement between the connecting rod 36 and the carbide tip 40. The carbide tip 40 can extend into the thru bore 47.

The thru bore 47 can have a plurality of elastomeric choke element inner ridges, such as elastomeric choke element inner ridge 48, extending into the thru bore 47. The inline choke 1 can include from about two elastomeric choke element inner ridges to about ten elastomeric choke element inner ridges. The elastomeric choke element inner ridges 48 can have rounded edges or other shapes.

In operation, the elastomeric choke element outer tapered edge 46 can push against the piston tapered inner edge 52 of the piston 50, allowing the piston 50 to compress the elastomeric choke element 44 longitudinally. As such, the elastomeric choke element 44 can form a choke with the carbide tip 40 to restrict flow of the drilling fluid 3.

The elastomeric choke element 44 can be supported in the choke longitudinal bore 10 by a support ring 42, which can prevent the elastomeric choke element 44 from compressing out of the annular recess 24 and into the choke longitudinal bore 10, which could damage the inline choke 1.

Figure 2:
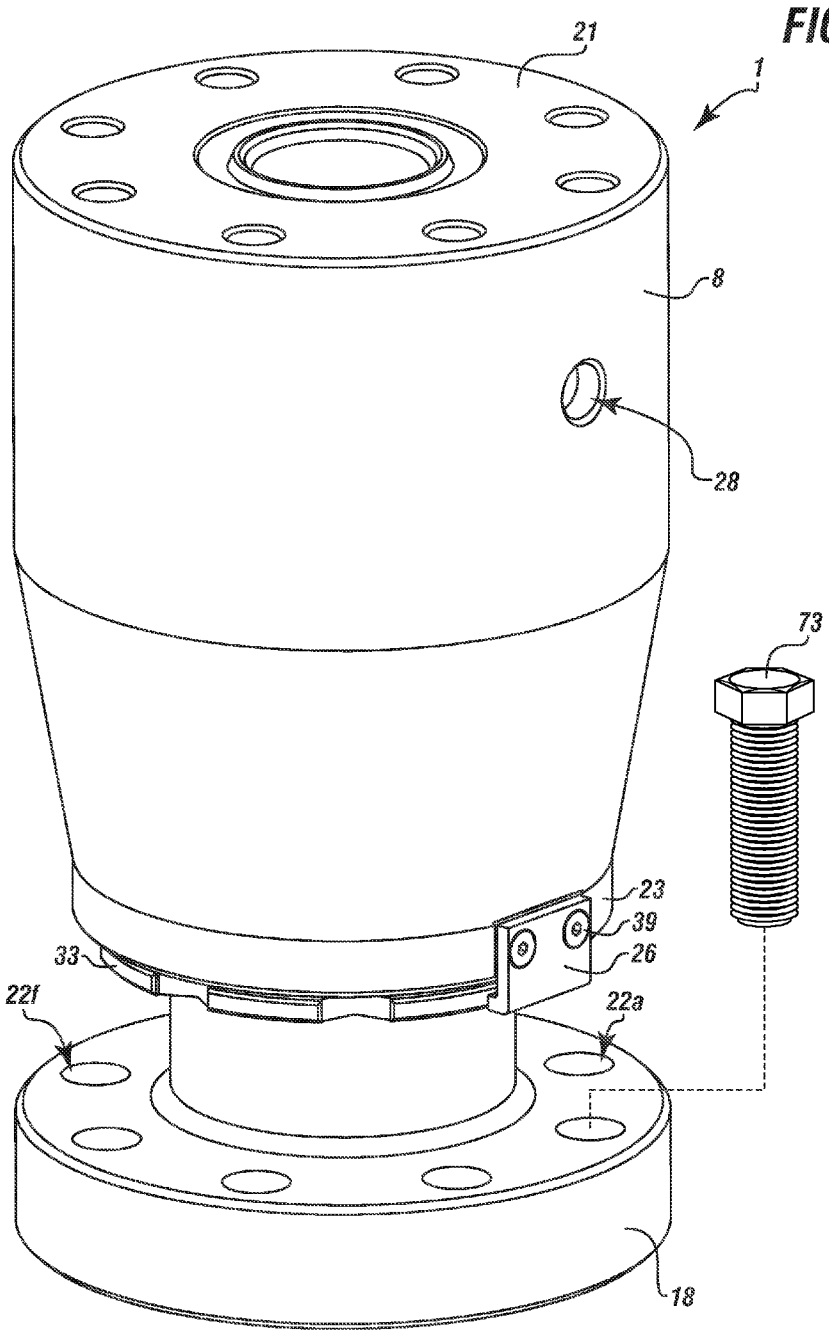
FIG. 2 is a perspective view of the inline choke in FIG. 1.

FIG. 2 depicts a perspective view of the inline choke of FIG. 1 with the flanged connection 18 connected to the choke body 8. The choke body 8 can be made of steel.

The flanged connection 18 can have a plurality of flanged connection thru bores, such as flanged connection thru bores 22*a* and 22*f*. The plurality of flanged connection thru bores 22*a* and 22*f* can be disposed about the flanged connection 18.

Fasteners, such as fastener 73, can engage through each flanged connection thru bore 22*a* and 22*f* to fasten the inline choke 1 to a flange connection on a choke and kill manifold. The fasteners 73 can be bolts.

The locking plate 26 can be removably fastened to a flanged connection extension 33 and the cylindrical outer surface 23 for aligning the choke body 8 with the flanged connection 18.

Locking plate fasteners 39 can removably attach the locking plate 26 to the choke body 8.

This Figure also shows that the inline choke 1 can have an API studded top connection 21 and the close port 28 can be disposed through the choke body 8.

Figure 3:
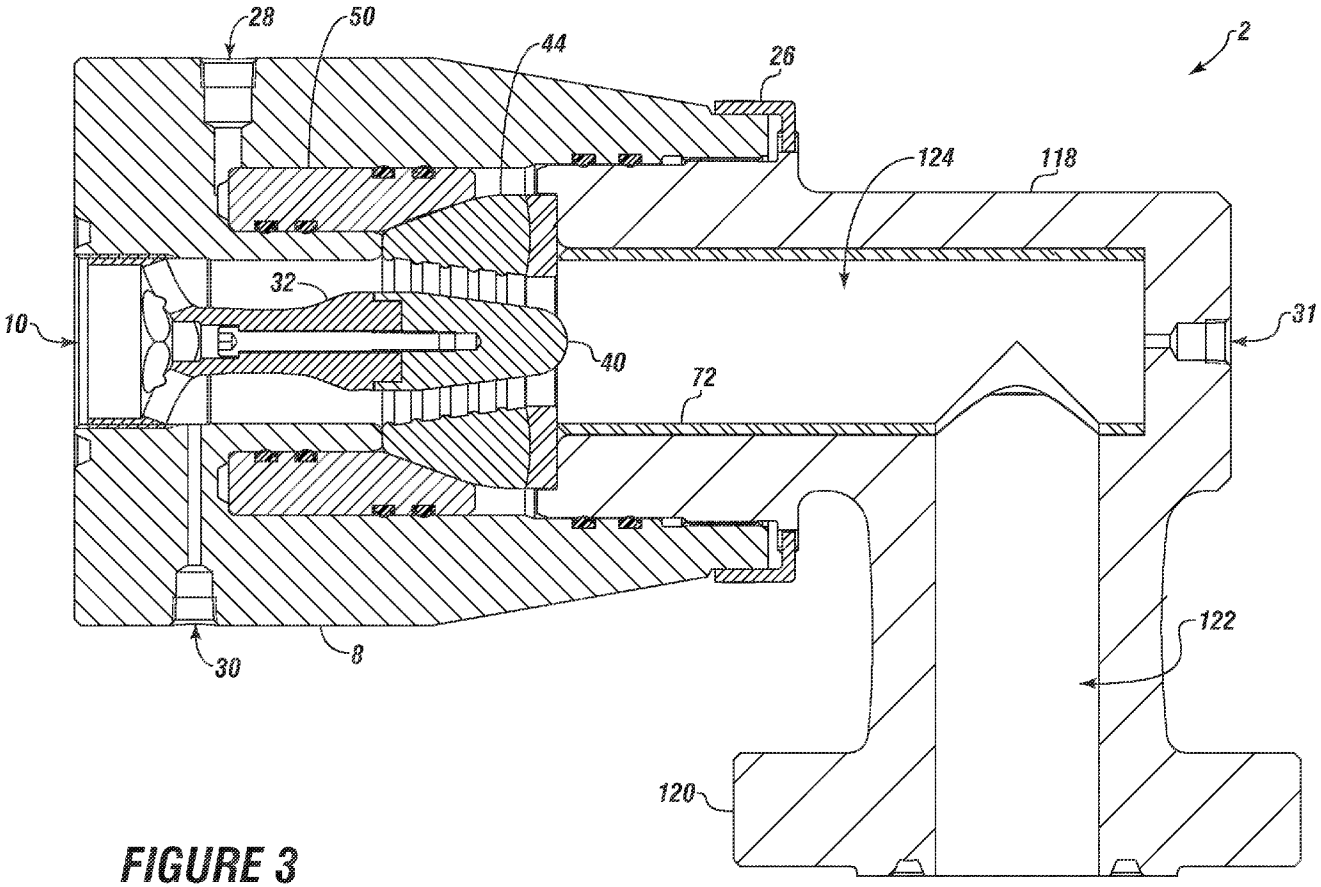
FIG. 3 is a cross sectional view of an embodiment of an angled choke.

FIG. 3 depicts a cross sectional view of an angled choke 2. The angled choke 2 is shown having a choke body 8 with a choke longitudinal bore 10.

The angled choke 2 can have an angled flanged connection 118 having a right angle conduit 122 engaged with an API connector 120. The API connector 120 can connect the angled choke 2 to a gate valve or similar device in the choke and kill manifold.

The angled flanged connection 118 can have a central conduit 124 axially aligned and in fluid communication with the choke longitudinal bore 10. The central conduit 124 is also referred to as a first flanged connection longitudinal bore. The right angle conduit 122 can be in fluid communication with the central conduit 124, allowing the angled choke 2 to be used to replace existing chokes. The right angle conduit 122 is also referred to herein as a second flanged connection longitudinal bore.

A first test port 30 can be used to determine pressure in the choke longitudinal bore 10. The angled flanged connection 118 can have a second test port 31, which can be used to determine pressure in the central conduit 124, the right angle conduit 122, or combinations thereof.

The first test port 30 and the second test port 31 can be used to simultaneously and continuously determine pressures before the piston 50 compresses the elastomeric choke element 44, during compression of the elastomeric choke element 44 by the piston 50, and after the piston 50 compresses the elastomeric choke element 44.

Also shown are the choke bean 32, the carbide tip 40, the close port 28, the locking plate 26, and the erosion resistant liner 72.

Figure 4:
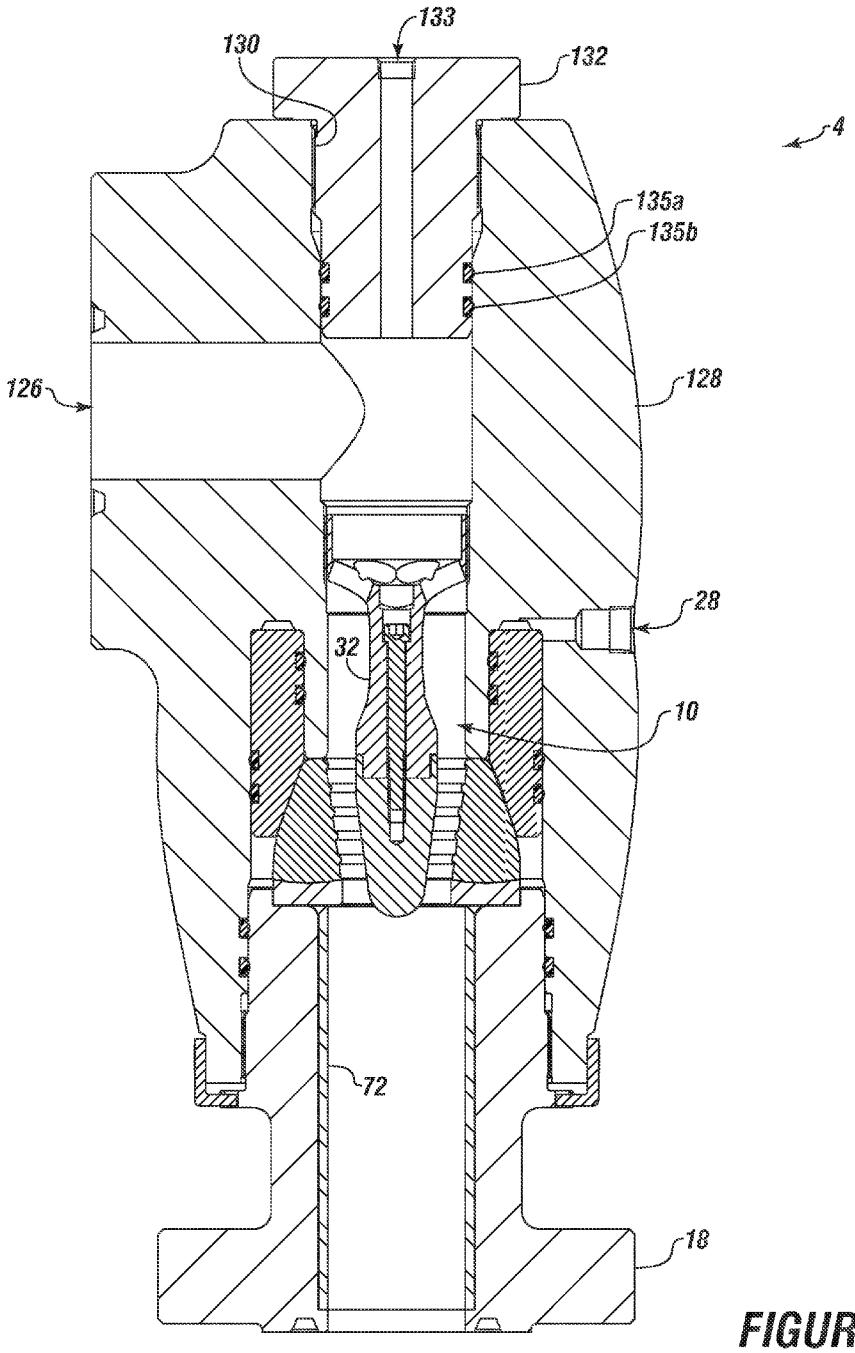
FIG. 4 is a cross sectional view of a choke with a right angle studded connection.

FIG. 4 depicts another embodiment of an angled choke 4. The angled choke 4 can have a right angle studded API connection 126 in fluid communication with the choke bean 32.

The angled choke 4 can have an upper body 128 with an upper body longitudinal bore 130. The upper body longitudinal bore 130 can have an access plug 132 disposed therein.

An upper test port 133 can be disposed through the access plug 132 for providing access to test pressure in the right angled studded API connection 126.

The access plug 132 can be sealed in the upper body longitudinal bore 130 with seals 135*a* and 135*b*. The seals 135*a* and 135*b* can be elastomeric seals or piston seals.

The access plug 132 can be threadably engaged with the upper body longitudinal bore 130, allowing for insertion and removal of the access plug 132 for maintenance, easy repair, and replacement of the choke bean 32.

Also shown is the choke bean 32 in the choke longitudinal bore 10, the close port 28, the flanged connection 18, and the erosion resistant liner 72.

Figure 5:
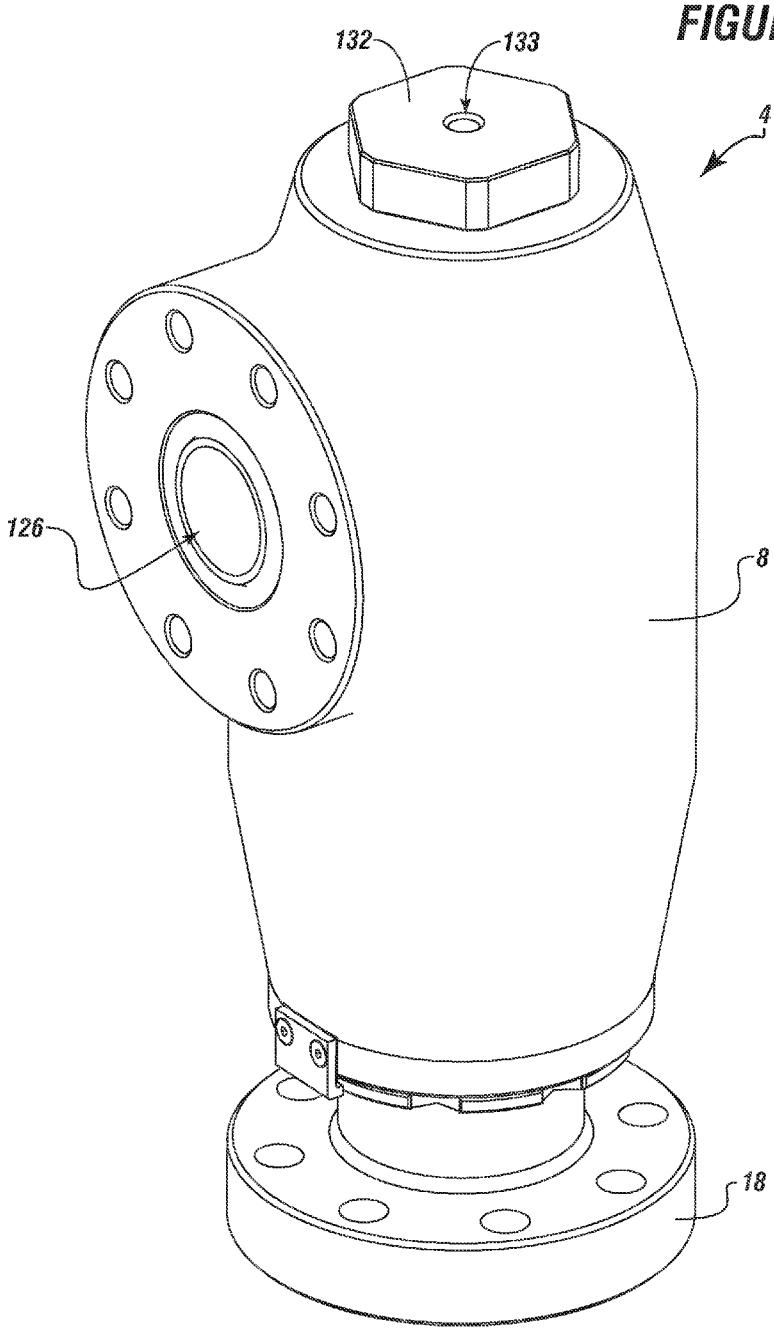
FIG. 5 is a perspective view of the choke in FIG. 4.

FIG. 5 depicts a perspective view of the angled choke 4 of FIG. 4 showing the right angled studded API connection 126, the choke body 8, the flanged connection 18, upper test port 133, and the access plug 132.

Figure 6A:
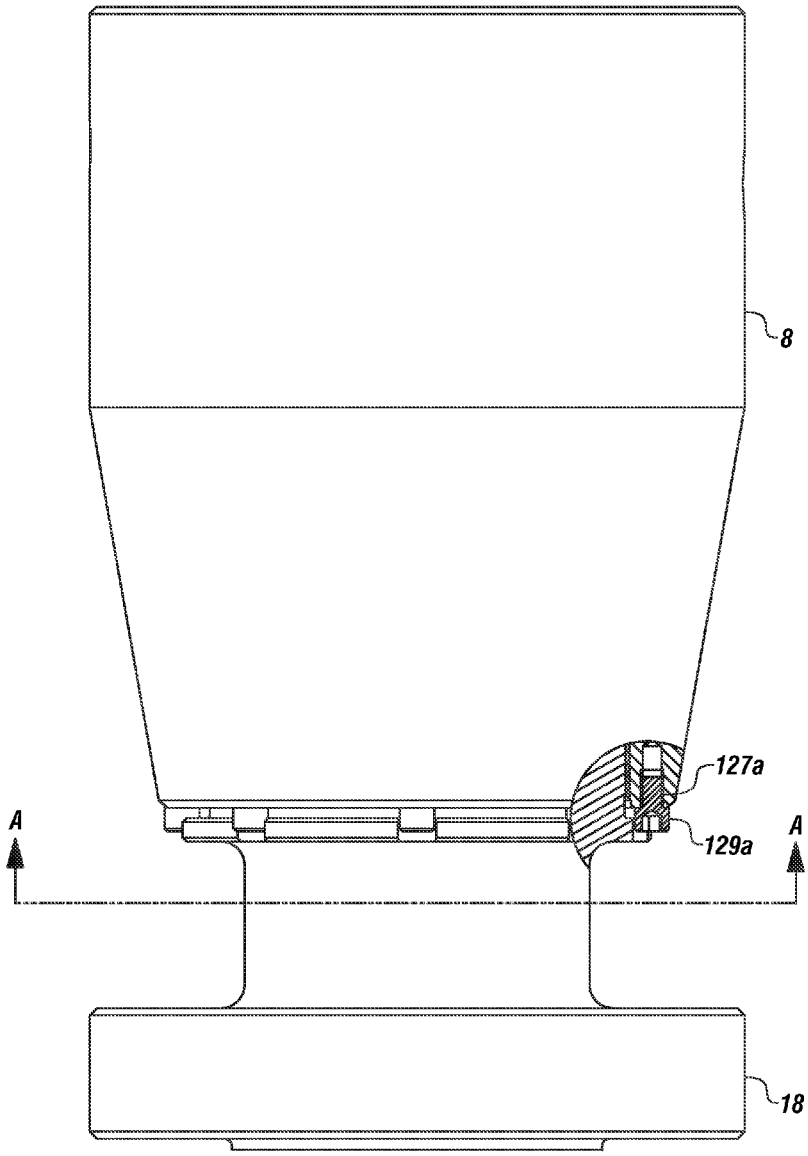
FIGS. 6A-6B depict an embodiment of a connection between a flanged connection and a choke body.

FIG. 6A depicts a flanged connection fastener 129*a* engaged into a choke body fastener hole 127*a*, connecting the flanged connection 18 to the choke body 8.

Figure 6B:
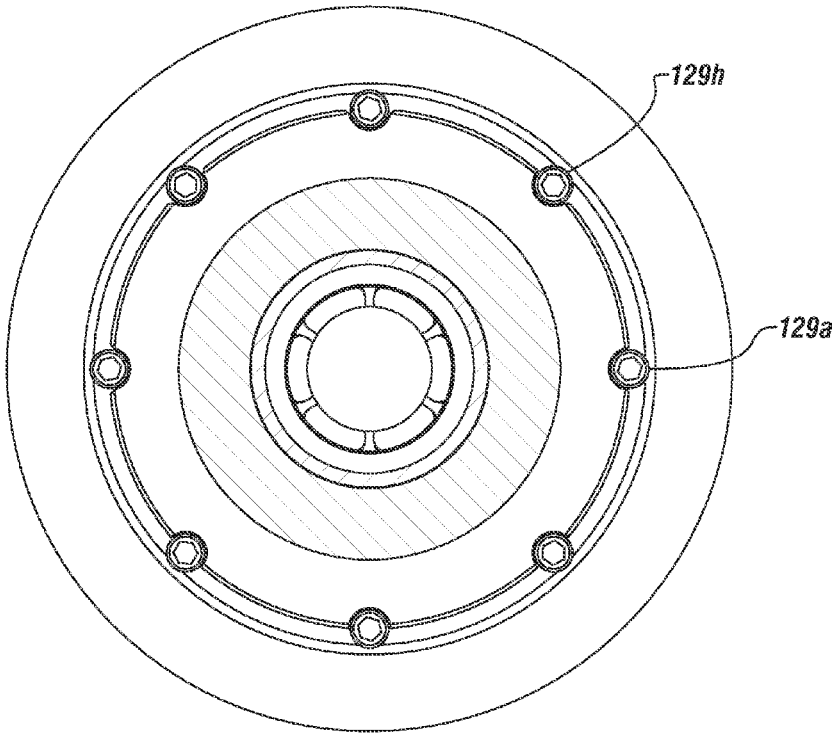

FIG. 6B is a view along line A-A of FIG. 6A, and depicts the flanged connection fasteners 129*a* and 129*h* engaged into the choke body fastener holes.

The flanged connection fasteners 129*a* and 129*h* and the choke body fastener holes can be used in place of the locking plate or in addition to the locking plate.

Figure 7:
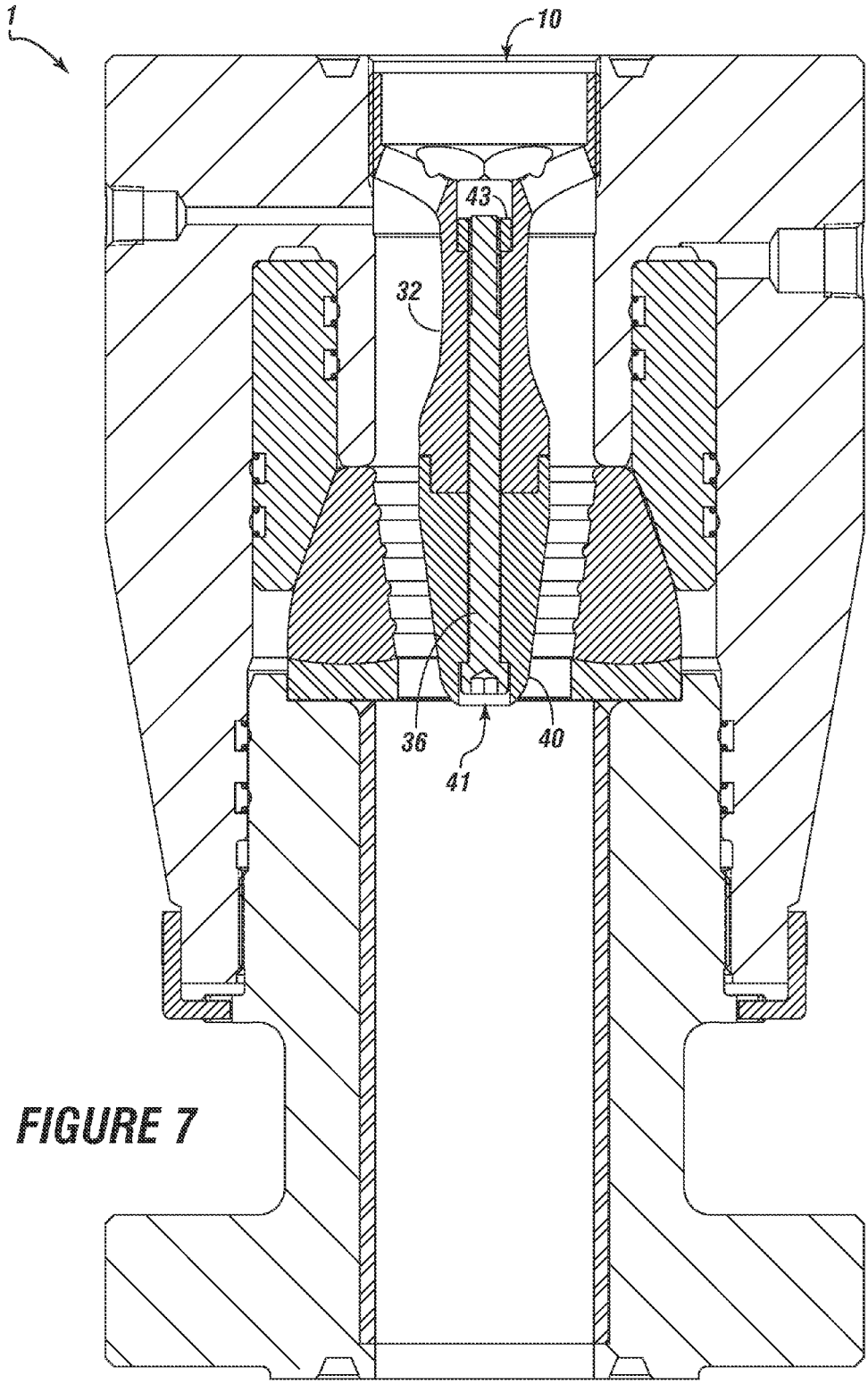
FIG. 7 is a cross sectional view of another embodiment of the angled choke having a carbide tip with a counter bore.

FIG. 7 depicts an embodiment of the inline choke 1 with a carbide tip 40 having a counter bore 41 axially aligned with the choke longitudinal bore 10.

The carbide tip 40 with the counter bore 41 can slidably and removably engage a connecting rod 36.

A locking nut 43 can engage the connecting rod 36 with the choke bean 32.

The configuration of the carbide tip 40, the connecting rod 36, the counter bore 41, and the choke bean 32 as depicted in FIG. 7 can be incorporated into the other embodiments of the inline choke and angled choke disclosed herein.

While these embodiments have been described with emphasis on the embodiments, it should be understood that within the scope of the appended claims, the embodiments might be practiced other than as specifically described herein.

What is claimed is:

1. An inline choke for oil field equipment for flowing a drilling fluid to a choke and kill manifold, the inline choke comprising:

a. a choke body comprising:
   (i) a top;
   (ii) a choke longitudinal bore disposed through the choke body;
   (iii) an outer body portion and an inner body portion, wherein a piston cavity is formed between the outer body portion and the inner body portion;
   (iv) inner body threads in the choke longitudinal bore proximate the top; and
   (v) outer body threads on the outer body portion;

b. a flanged connection sealed to the outer body portion, wherein the flanged connection comprises:
   (i) a flanged connection longitudinal bore axially aligned with the choke longitudinal bore and in fluid communication with the choke longitudinal bore; and
   (ii) flanged connection threads on the flanged connection, wherein the flanged connection threads are threadably engaged with the outer body threads;

c. a studded top connection on the top of the choke body;

d. a locking plate connected to the flanged connection and the outer body portion, wherein the locking plate is configured to index the flanged connection to the outer body portion and align the studded top connection with the oil field equipment;

e. a piston disposed in the piston cavity between the outer body portion and the inner body portion;

f. a close port in the choke body, wherein the close port is in fluid communication with the piston cavity to provide a hydraulic control fluid to the piston;

g. a first test port in the choke body for sensing pressure in the choke longitudinal bore;

h. a choke bean axially disposed in the choke longitudinal bore and threaded to the inner body threads, wherein the choke bean is configured to receive the drilling fluid and flow the drilling fluid to the choke and kill manifold;

i. a connecting rod axially extending from the choke bean;

j. a carbide tip removably engaged with the connecting rod and extending axially in the choke longitudinal bore;

k. an elastomeric choke element disposed between the piston and the carbide tip in the choke body, wherein the elastomeric choke element has an elastomeric choke element tapered thru bore, and wherein the carbide tip is disposed within the elastomeric choke element tapered thru bore;

l. a support ring disposed between the elastomeric choke element and the flanged connection;

m. an erosion resistant liner disposed in the flanged connection and around the flanged connection longitudinal bore;

n. a plurality of first rod seals sealing between the piston and the outer body portion;

o. a plurality of second rod seals sealing between the piston and the inner body portion; and p. a plurality of third rod seals sealing between the outer body portion and the flanged connection, wherein when the hydraulic control fluid passes into the close port, the hydraulic control fluid engages the piston to move the piston in a first direction axially within the choke longitudinal bore, thereby engaging the piston with the elastomeric choke element, wherein the piston is configured to compress the elastomeric choke element around the carbide tip to cause choking or restricting of the drilling fluid passing through the choke bean, and wherein the choking or restricting of the drilling fluid enables the inline choke to control pressure of the drilling fluid.

2. The inline choke of claim 1, wherein the piston comprises: a piston tapered inner edge, a piston upper inner seal face, a piston outer seal face, a piston top, and a piston bottom.

3. The inline choke of claim 1, wherein the studded top connection and the flanged connection are configured to accommodate oil field equipment having: a 1 and 13/16 inch diameter connection, a 2 and 1/16 inch diameter connection, a 2 and 9/16 inch diameter connection, a 3 and 1/16 inch diameter connection, or a 4 and 1/16 inch diameter connection.

4. The inline choke of claim 1, wherein the elastomeric choke element comprises: an elastomeric choke element body and an elastomeric choke element outer tapered edge, and wherein the elastomeric choke element is made of:

a. a compressible synthetic rubber;

b. a compressible polymer composite having a durometer of ranging from 60 duro to 90 duro;

c. a material configured to withstand temperatures ranging from −20 degrees Fahrenheit to 250 degrees Fahrenheit;

d. a hydrogenated nitrile butadiene rubber; or e. combinations thereof.

5. The inline choke of claim 1, further comprising a plurality of elastomeric choke element inner ridges disposed around the elastomeric choke element tapered thru bore for sealing against the carbide tip.

6. The inline choke of claim 5, wherein the plurality of elastomeric choke element inner ridges includes from two elastomeric choke element inner ridges to eight elastomeric choke element inner ridges.

7. The inline choke of claim 1, wherein the erosion resistant liner comprises: high carbon steel, carbide, ceramic, a ceramic and glass combination, or combinations thereof.

8. The inline choke of claim 1, wherein the flanged connection comprises a plurality of flanged connection thru bores with a fastener engaged through each flanged connection thru bore.

9. The inline choke of claim 1, wherein the outer body portion has tapered outer sides.

10. The inline choke of claim 1, further comprising:

a. a right angle studded connection in fluid communication with the choke bean through the choke body, wherein the choke body has an upper body with an upper body longitudinal bore in fluid communication with the right angle studded connection;

b. an access plug disposed in the upper body longitudinal bore; and c. an upper test port disposed in the access plug for providing access to test pressure in the right angled studded connection.

11. An angled choke for oil field equipment for flowing a drilling fluid to a choke and kill manifold, the angled choke comprising:

a. a choke body comprising:

(i) a top;

(ii) a choke longitudinal bore disposed through the choke body;

(iii) an outer body portion and an inner body portion, wherein a piston cavity is formed between the outer body portion and the inner body portion;

(iv) inner body threads in the choke longitudinal bore proximate the top; and (v) outer body threads on the outer body portion;

b. an angled flanged connection sealed to the outer body portion, wherein the angled flanged connection comprises:

(i) a first flanged connection longitudinal bore axially aligned with the choke longitudinal bore and in fluid communication with the choke longitudinal bore;

(ii) flanged connection threads on the angled flanged connection, wherein the flanged connection threads are threadably engaged with the outer body threads; and (iii) a second flanged connection longitudinal bore formed at a right angle to the first flanged connection longitudinal bore, wherein the second flanged connection longitudinal bore is in fluid communication with the first flanged connection longitudinal bore;

c. a studded top connection disposed on the top of the choke body;

d. a locking plate connected to the angled flanged connection and the outer body portion, wherein the locking plate is configured to index the angled flanged connection to the outer body portion and align the studded top connection with the oil field equipment;

e. a piston disposed in the piston cavity between the outer body portion and the inner body portion;

f. a close port in the choke body, wherein the close port is in fluid communication with the piston cavity to provide a hydraulic control fluid to the piston;

g. a first test port in the choke body for sensing pressure in the choke longitudinal bore;

h. a second test port in the angled flanged connection for sensing pressure in the first flanged connection longitudinal bore, the second flanged connection longitudinal bore, or combinations thereof;

i. a choke bean axially disposed in the choke longitudinal bore and threaded to the inner body threads, wherein the choke bean is configured to receive the drilling fluid and flow the drilling fluid to the choke and kill manifold;

j. a connecting rod axially extending from the choke bean;

k. a carbide tip removably engaged with the connecting rod and extending axially into the choke longitudinal bore;

l. an elastomeric choke element disposed between the piston and the carbide tip in the choke body, wherein the elastomeric choke element has an elastomeric choke element tapered thru bore, and wherein the carbide tip is disposed within the elastomeric choke element tapered thru bore;

m. a support ring disposed between the elastomeric choke element and the angled flanged connection;

n. an erosion resistant liner disposed in the angled flanged connection and around the first flanged connection longitudinal bore;

o. a plurality of first rod seals sealing between the piston and the outer body portion;

p. a plurality of second rod seals sealing between the piston and the inner body portion; and q. a plurality of third rod seals sealing between the inner outer body portion and the angled flanged connection, wherein when the hydraulic control fluid passes into the close port, the hydraulic control fluid engages the piston to move the piston in a first direction axially within the choke longitudinal bore, thereby: engaging the piston with the elastomeric choke element, wherein the piston is configured to compress the elastomeric choke element around the carbide tip to cause choking or restricting of the drilling fluid passing through the choke bean, and wherein the choking or restricting of the drilling fluid enables the angled choke to control pressure of the drilling fluid.

12. The angled choke of claim 11, wherein the piston comprises: a piston tapered inner edge, a piston upper inner seal face, a piston outer seal face, a piston top, and a piston bottom.

13. The angled choke of claim 11, wherein the studded top connection and the flanged connection are configured to accommodate oil field equipment having: a 1 and 13/16 inch diameter connection, a 2 and 1/16 inch diameter connection, a 2 and 9/16 inch diameter connection, a 3 and 1/16 inch diameter connection, or a 4 and 1/16 inch diameter connection.

14. The angled choke of claim 11, wherein the elastomeric choke element comprises: an elastomeric choke element body and an elastomeric choke element outer tapered edge, and wherein the elastomeric choke element is made of:

a. a compressible synthetic rubber;

b. a compressible polymer composite having a durometer of ranging from 60 duro to 90 duro;

c. a material configured to withstand temperatures ranging from −20 degrees Fahrenheit to 250 degrees Fahrenheit;

d. a hydrogenated nitrile butadiene rubber; or e. combinations thereof.

15. The angled choke of claim 11, further comprising a plurality of elastomeric choke element inner ridges disposed around the elastomeric choke element tapered thru bore for sealing against the carbide tip.

16. The angled choke of claim 11, wherein the erosion resistant liner comprises: high carbon steel, carbide, ceramic, a ceramic and glass combination, or combinations thereof.

17. The angled choke of claim 11, wherein the angled flanged connection comprises a plurality of flanged connection thru bores with a fastener engaged through each flanged connection thru bore.

18. The angled choke of claim 11, wherein the outer body portion has tapered outer sides.

19. The angled choke of claim 11, further comprising:

a. a right angle studded connection in fluid communication with the choke bean through the choke body, wherein the choke body has an upper body with an upper body longitudinal bore in fluid communication with the right angle studded connection;

b. an access plug disposed in the upper body longitudinal bore; and c. an upper test port disposed in the access plug for providing access to test pressure in the right angled studded connection.

20. An angled or inline choke for oil field equipment for flowing a drilling fluid to a choke and kill manifold, the angled or inline choke comprising:

a. a choke body comprising:
   (i) a top;
   (ii) a choke longitudinal bore disposed through the choke body;
   (iii) an outer body portion and an inner body portion, wherein a piston cavity is formed between the outer body portion and the inner body portion;
   (iv) inner body threads in the choke longitudinal bore proximate the top; and
   (v) outer body threads on the outer body portion;

b. a flanged connection sealed to the outer body portion, wherein the flanged connection comprises:
   (i) a flanged connection longitudinal bore axially aligned with the choke longitudinal bore and in fluid communication with the choke longitudinal bore; and
   (ii) flanged connection threads on the flanged connection, wherein the flanged connection threads are threadably engaged with the outer body threads;

c. a studded top connection on the top of the choke body;

d. a connection between the flanged connection and the outer body portion, wherein the connection comprises:
   (i) a locking plate connected to the flanged connection and the outer body portion, wherein the locking plate is configured to index the flanged connection to the outer body portion and align the studded top connection with the oil field equipment; or
   (ii) flanged connection fasteners fastening the flanged connection to the outer body portion;

e. a piston disposed in the piston cavity between the outer body portion and the inner body portion;

f. a close port in the choke body, wherein the close port is in fluid communication with the piston cavity to provide a hydraulic control fluid to the piston;

g. a first test port in the choke body for sensing pressure in the choke longitudinal bore;

h. a choke bean axially disposed in the choke longitudinal bore and threaded to the inner body threads, wherein the choke bean is configured to receive the drilling fluid and flow the drilling fluid to the choke and kill manifold;

i. a carbide tip comprising a counter bore axially aligned with the choke longitudinal bore, wherein the carbide tip is slidably and removably engaged with a connecting rod, and wherein a locking nut engages the connecting rod with the choke bean;

j. an elastomeric choke element disposed between the piston and the carbide tip in the choke body, wherein the elastomeric choke element has an elastomeric choke element tapered thru bore, and wherein the carbide tip is disposed within the elastomeric choke element tapered thru bore;

k. a support ring disposed between the elastomeric choke element and the flanged connection;

l. an erosion resistant liner disposed in the flanged connection and around the flanged connection longitudinal bore;

m. a plurality of first rod seals sealing between the piston and the outer body portion;

n. a plurality of second rod seals sealing between the piston and the inner body portion; and o. a plurality of third rod seals sealing between the inner outer body portion and the flanged connection, wherein when the hydraulic control fluid passes into the close port, the hydraulic control fluid engages the piston to move the piston in a first direction axially within the choke longitudinal bore, thereby: engaging the piston with the elastomeric choke element, wherein the piston is configured to compress the elastomeric choke element around the carbide tip to cause choking or restricting of the drilling fluid passing through the choke bean, and wherein the choking or restricting of the drilling fluid enables the angled or inline choke to control pressure of the drilling fluid.

* * * * *